United States Patent [19]

Kleber et al.

[11] 4,322,302

[45] Mar. 30, 1982

[54] AGENT FOR THE LIQUID PARAFFIN WAXING OF YARNS

[75] Inventors: Rolf Kleber, Neu-Isenburg; Lothar Jaeckel, Flörsheim am Main, both of Fed. Rep. of Germany

[73] Assignee: Hoechst Aktiengesellschaft, Frankfurt, Fed. Rep. of Germany

[21] Appl. No.: 164,036

[22] Filed: Jun. 30, 1980

[30] Foreign Application Priority Data

Jul. 4, 1979 [DE] Fed. Rep. of Germany ..... 2927027

[51] Int. Cl.[3] ..... D06M 13/02; D06M 13/38; D06M 13/18

[52] U.S. Cl. ..... 252/8.8; 106/271; 252/8.9; 427/389.9

[58] Field of Search ..... 252/8.8, 8.9; 106/270, 106/271; 427/394, 389.9

[56] References Cited

U.S. PATENT DOCUMENTS

| | | | |
|---|---|---|---|
| 2,197,464 | 4/1940 | Brodersen et al. | 252/8.8 X |
| 2,974,106 | 3/1961 | Fronmuller et al. | 252/8.8 X |
| 2,995,520 | 8/1961 | Luuisi et al. | 252/8.8 |

*Primary Examiner*—Michael R. Lusignan
*Attorney, Agent, or Firm*—Connolly and Hutz

[57] ABSTRACT

Agent for the liquid paraffin waxing of yarns which consists of (a) from 5 to 20% of paraffin, melting range of 45° to 60° C.;

(b) from 2 to 10% of one or several alkyl imidazolines of the formula I

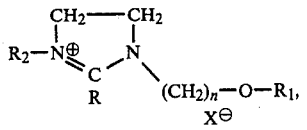

I in which

R is $C_{12}$–$C_{22}$-alkyl, alkenyl or hydroxyalkyl, $R_1$ is hydrogen or $C_1$–$C_{22}$-saturated or unsaturated aliphatic or aromatic acyl, $R_2$ is hydrogen, $C_1$–$C_4$-alkyl or $C_1$–$C_4$-hydroxyalkyl, n is a number of from 2 to 6, and X is a halogen anion, a $C_1$–$C_4$-alkyl sulfate anion, a $C_1$–$C_4$-dialkyl phosphate anion, or a $C_1$–$C_4$-alkyl carboxylate anion;

(c) from 1 to 5% of one or several aminoxides of the formula II

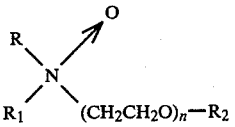

II in which

R is $C_8$–$C_{12}$-alkyl or alkenyl, $R_1$ is $C_1$–$C_4$ -alkyl, $R_2$ is hydrogen or $C_1$–$C_4$-alkyl, and n is a number of from 0 to 6, and (d) from 5 to 20% of one or several polyglycol ethers of the formula III $$R—O—(C_2H_4O)_n—H \qquad \text{III,}$$

in which

R is $C_8$–$C_{18}$-alkyl or alkenyl and n is a number of from 3 to 12, as well as water ad 100%.

2 Claims, No Drawings

AGENT FOR THE LIQUID PARAFFIN WAXING OF YARNS

In order to use dyed or undyed staple fiber yarns for knitting, it has been a common method to treat said yarns during a rewinding process with a solid paraffin block. A determined amount of solid paraffin is applied onto the fiber which thus reaches the low friction coefficient required for further processing, i.e. favorable sliding properties. It goes without saying that this process of dry paraffin waxing involves certain problems in practice. The amount applied of dry paraffin may vary depending on the pressure between the fiber and the paraffin block. The solid paraffin may sublime in subsequent heating processes (ironing, fixing), thus showing a tendency to blooming. The rigid dry paraffin indeed imparts to the material a satisfactory sliding behavior for further processing, however, without implying an actual softening effect with its application. In the case of dry paraffin waxed articles it is therefore necessary to soften the same in a subsequent process step by applying an additional softening agent.

It has therefore been the object underlying this invention to impart to staple fiber yarns uniform low friction values required for further processing, i.e. favorable sliding properties in combination with a satisfactory softening effect. The task may be solved by employing an agent for the liquid paraffin waxing of yarns which has the following composition:

(a) from 5 to 20% of paraffin, melting range of 45° to 60° C.

(b) from 2 to 10% of one or several alkyl imidazolines of the formula I

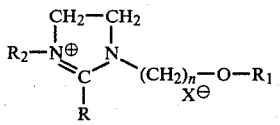

I in which

R is alkyl, alkenyl or hydroxyalkyl, each with 12 to 22 carbon atoms, $R_1$ is hydrogen or $C_1$–$C_{22}$-saturated or unsaturated aliphatic or aromatic acyl, $R_2$ is hydrogen, $C_1$–$C_4$-alkyl or $C_1$–$C_4$-hydroxyalkyl, n is a number of from 2 to 6, and X is a halogen anion, a $C_1$–$C_4$-alkyl sulfate anion, a $C_1$–$C_4$-dialkyl phosphate anion, or a $C_1$–$C_4$-alkyl carboxylate anion;

(c) from 1 to 5% of one or several aminoxides of the formula II

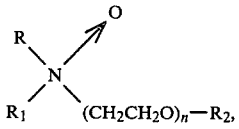

II in which

R is $C_8$–$C_{12}$-alkyl or alkenyl, $R_1$ is $C_1$–$C_4$-alkyl, $R_2$ is hydrogen or $C_1$–$C_4$-alkyl, and n is a number of from 0 to 6, and (d) from 5 to 20% of one or several polyglycol ethers of the formula III $$R—O(C_2H_4O)_n—H \qquad \text{III}$$

in which

R is $C_8$–$C_{18}$-alkyl or alkenyl and n is a number of from 3 to 12, as well as water ad 100%.

Preference is given to an agent of the following composition:

from 8 to 12% of paraffin (m.p. 50° to 53° C.), from 3 to 6% of an imidazoline of formula I, in which R is $C_{12}$–$C_{18}$-alkyl, $R_1$ is $C_{16}$–$C_{22}$-alkanoyl, $R_2$ is hydrogen, $X^-$ is $Cl^-$ or $CH_3COO^-$ and n is 2 or 3, from 3 to 5% of an aminoxide of formula II, in which R is $C_8$–$C_{18}$-alkyl or alkenyl, $R_1$ and $R_2$ are methyl and n is zero, from 6 to 10% of a polyglycol ether of formula III, in which R is coconut oil alkyl ($C_{12}$–$C_{18}$-alkyl and alkenyl), n is a number of from 4 to 8, and water ad 100%.

The paraffin dispersion is prepared by thoroughly mixing all components at a temperature of more than 70° to 80° C., with the particular advantage that a homogenizer is not required.

The clear dispersions are stable and may be diluted with cold water to the intended final concentration in an aqueous liquor. These paraffin dispersions, which upon dilution with water form fine dispersions that are fast to storage and to shearing, may be employed instead of solid dry paraffin for the waxing of staple fiber yarns of native and synthetic fibers. They may be labelled pseudocationically dispersed systems and are marked by a high substantivity when used in a dilute liquor. The pH value of the paraffin dispersions applied is advantageously in the range of from 3 to 6 and is adjusted to this value by means of acids.

The paraffin dispersions are applied in the common dyeing apparatuses, as they are used for the dyeing of textile yarns. A goods-to-liquor ratio of from 1:5 to 1:40 at a temperature in the range of from 10° to 90° C. is employed. The application is advantageously effected following the dyeing process, by treating the yarn after rinsing with a dispersion of the above-described nature in a dilute aqueous form, which contains from 0.1 to 2% by weight, preferably from 0.3 to 1% by weight of the agent of the above composition, calculated on the yarn weight.

The yarns waxed in this manner show besides the intended sliding properties a pleasant soft feel which makes the application of an additional softening agent superfluous. Due to the dispersing agents incorporated in the systems there does not occur an electrostatic charge which might adversely affect the knitting. The paraffin dispersions of the invention do not contain any organic solvents, either, which might be hazardous for the environment, especially when operating in open apparatuses. They contain as sliding component merely the inexpensive paraffin, and for producing the softening effect and the favorable sliding behavior they do not require any additional components, such as fatty acid esters, which are too expensive as compared with paraffin. The paraffin dispersions of the invention show a high substantivity in combination with a high wetting power, which allows the application also in short test periods and at a low temperature.

The dispersions of the invention impart to yarns a high antistatic effect combined with favorable sliding properties.

The dispersions described in the following examples are prepared by simply mixing the individual components. The percentages are to be understood as being percent by weight. EO means ethylene oxide.

EXAMPLE 1

Paraffin dispersion consisting of 15 parts of paraffin (m.p. 50°–53° C.)
5 parts of an imidazoline of the formula I, in which
R is a mixture of 45% of $C_{15}$- and 55% of $C_{17}$-alkyl,
$R_1$ is a mixture of 45% of $C_{16}$- and 55% of $C_{18}$-acyl,
$R_2$ is hydrogen,
n is 2 and
$X^-$ is $CH_3CO_2^-$,
4 parts of coconut oil-alkyl-dimethyl aminoxide;
10 parts of coconut oil alcohol x 5 EO,
100 parts of demineralized water.
The pH value is about 4.

EXAMPLE 2

Paraffin dispersion consisting of 17 parts of paraffin (m.p. 50° to 53° C.);
7 parts of the imidazoline of Example 1;
4 parts of oleyl diethyl aminoxide,
8 parts of oleyl alcohol x 7 EO,
100 parts of demin. water.
The pH is about 4.2.

EXAMPLE 3

Paraffin dispersion consisting of 13 parts of paraffin (m.p. 52° to 54° C.)
6 parts of an imidazoline of the formula I, in which
R is a mixture of 5% of $C_{13}$, 30% of $C_{15}$, 35% of $C_{17}$-alkyl and 30% of $C_{17}$-alkenyl,
$R_1$ is a mixture of 5% of $C_{14}$-, 30% of $C_{16}$-, 35% of $C_{18}$-acyl and 30% of $C_{18}$-acenyl,
$R_2$ is hydrogen,
n is 2 and
$X^-$ *is acetate,*
3 parts of an aminoxide of the formula II, in which
R is a mixture of 70% of $C_{12}$- and 30% of $C_{14}$-alkyl,
$R_1$ and $R_2$ are methyl and
n is 0, and
6 parts of coconut oil alcohol x 6 EO,
6 parts of oleyl alcohol x 5 EO,
100 parts of demin. water.
The pH is 4.5.

EXAMPLE 4

Paraffin dispersion consisting of 14 parts of paraffin (m.p. 52° to 54° C.),
2.4 parts of the imidazoline used in Example 1,
0.6 part of an imidazoline of the formula I, in which
R is a mixture of 5% of $C_{13}$-, 30% of $C_{15}$-, 35% of $C_{17}$-alkyl and 30% of $C_{17}$-alkenyl,
$R_1$ and $R_2$ are hydrogen,
n is 2 and
$X^-$ is $CH_3COO^-$,
6 parts of coconut oil-alkyl-dimethyl aminoxide,
10 parts of $C_{12}/C_{14}$- alcohol x 10 EO, and
100 parts of demin. water.
The pH is 4.1.

EXAMPLE 5

After a previous disperse dyeing and rinsing process, yarns of 100% PES were treated in a cheese dyeing machine under high temperature conditions at 40° C. for 30 minutes with a goods-to-liquor ratio of 1:10 at a pH value of 5.5 with the dispersions described in Examples 1 to 4 in a dilute form. Said dispersions were diluted to a degree that the concentration of components (a) to (d) in the liquor, calculated on the yarn weight, was 2% by weight. After drying, the PES material had a smooth soft feel, as it can only be obtained for dry waxed yarns when adding a cationic softening agent.

The wet waxed yarns show very favorable sliding properties. At measuring rates of 20 and 100 m/minute the friction coefficient measured in the arrangement described in German Offenlegungsschrift No. 2,416,430 had the following values:

| Agent according to | μ values |
|---|---|
| Example 1 | 0.183–0.193 |
| Example 2 | 0.190–0.201 |
| Example 3 | 0.181–0.190 |
| Example 4 | 0.193–0.203 |

The material could be processed without difficulty, and after knitting the surface had a uniform homogeneous appearance.

The following antistatic values in Meg-Ohms were determined for the knitted goods at 22° C. and a relative humidity of 65%:

| Agent according to | Meg-Ohms |
|---|---|
| Example 1 | 40 |
| Example 2 | 30 |
| Example 3 | 30 |
| Example 4 | 25 |

Similarly favorable effects are obtained, if instead of PES yarns there are used wool yarns, cotton yarns or PAC yarns, or mixtures thereof.

What is claimed is:

1. Agent for the wet paraffin waxing of yarns which consists of
(a) from 5 to 20% of paraffin, melting range of 45° to 60° C.;
(b) from 2 to 10% of one or several alkyl imidazolines of the formula I

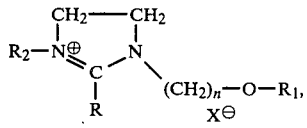

I in which
R is alkyl, alkenyl or hydroxyalkyl, each with 12 to 22 carbon atoms,
$R_1$ is hydrogen or $C_1$–$C_{22}$-saturated or unsaturated aliphatic or aromatic acyl, $R_2$ is hydrogen, $C_1$–$C_4$-alkyl or $C_1$–$C_4$-hydroxyalkyl, n is a number of from 2 to 6, and X is a halogen anion, a $C_1$–$C_4$-alkyl sulfate anion, a $C_1$–$C_4$-dialkyl phosphate anion, or a $C_1$–$C_4$-alkyl carboxylate anion;

(c) from 1 to 5% of one or several aminoxides of the formula II

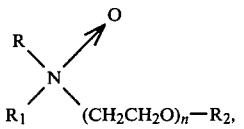

II in which

R is $C_8$–$C_{12}$-alkyl or alkenyl, $R_1$ is $C_1$–$C_4$-alkyl, $R_2$ is hydrogen or $C_1$–$C_4$-alkyl, and n is a number of from 0 to 6, and (d) from 5 to 20% of one or several polyglycol ethers of the formula III $$R—O(C_2H_4O)_n—H \qquad \text{III,}$$

in which

R is $C_8$–$C_{18}$-alkyl or alkenyl and n is a number of from 3 to 12, as well as water ad 100%.

2. Agent as claimed in claim 1 which consists of from 8 to 12% of paraffin (m.p. 50° to 53° C.), from 3 to 6% of an imidazoline of formula I, in which R is $C_{12}$–$C_{18}$-alkyl, $R^1$ is $C_{16}$–$C_{22}$-acyl, $R_2$ is hydrogen, $X^-$ is $Cl^-$, and n is 2 or 3, from 3 to 5% of an aminoxide of formula II, in which R is $C_8$–$C_{18}$-alkyl or alkenyl, $R_1$ and $R_2$ are methyl and n is zero, from 6 to 10% of a polyglycol ether of formula III, in which R is coconut oil alkyl, n is a number of from 4 to 8, and water ad 100%.

* * * * *